US006662396B1

(12) United States Patent
Scarpelli, Sr. et al.

(10) Patent No.: US 6,662,396 B1
(45) Date of Patent: Dec. 16, 2003

(54) PORTABLE GOLF BALL CLEANER

(76) Inventors: Carmine Scarpelli, Sr., 405 Cains Mill Rd., Williamstown, NJ (US) 08094-2412; Regina M. Scarpelli, 405 Cains Mill Rd., Williamstown, NJ (US) 08094-2412

( * ) Notice: Subject to any disclaimer, the term of this patent is extended or adjusted under 35 U.S.C. 154(b) by 77 days.

(21) Appl. No.: 10/075,641

(22) Filed: Feb. 15, 2002

(51) Int. Cl.[7] ..... A63B 47/04
(52) U.S. Cl. ..... 15/21.2; 15/160
(58) Field of Search ..... 15/21.2, 160

(56) References Cited

U.S. PATENT DOCUMENTS 1,918,529 A * 7/1933 Frater
2,807,037 A * 9/1957 Garske
3,102,291 A * 9/1963 Frater
3,119,533 A * 1/1964 Kimes
3,271,802 A * 9/1966 Thompson
3,400,416 A * 9/1968 Nicholson
3,748,676 A * 7/1973 Warren
4,060,876 A 12/1977 De Soto
4,155,002 A 5/1979 Cohen
4,350,457 A 9/1982 Carnahan
5,524,311 A 6/1996 Crossley
5,647,082 A * 7/1997 Garske
5,938,137 A 8/1999 Poulson

* cited by examiner

*Primary Examiner*—Randall E. Chin
(74) *Attorney, Agent, or Firm*—Donald R. Schoonover

(57) ABSTRACT

A golf ball cleaner includes a housing having an open channel into which a golf ball is inserted. Bristles on both sides of the channel engage the golf ball and the golf ball rests on a supporting platform that is moved back and forth in the channel. A cleaner liquid-containing compartment is located on one side of the housing and openings in an inner planar wall on which bristles are supported allow golf ball cleaner to be applied to the golf ball as that ball is moved in the channel.

4 Claims, 2 Drawing Sheets

PORTABLE GOLF BALL CLEANER

BACKGROUND OF THE INVENTION

1. Field of the Invention

The present invention relates to the general art of golf, and to the particular field of golf ball washing devices.

2. Discussion of the Related Art

Golf is one of the most popular participant sports in America and is continuously growing in popularity. As such, the art associated with golf and golf accessories has grown at a commensurate pace. Accordingly, the golf art contains a plethora of inventions which range from extremely sophisticated machines and devices to simple devices such as golf tees and the like. However, because of the immense popularity of golf, there is always a need for further improvements and devices.

One such device is the golf ball cleaner. Many golf courses have golf ball cleaners located near each tee area and still other golf courses have additional golf ball cleaners at other locations as well. However, no matter how many golf ball cleaners are located throughout the golf course, a golfer may not be near a golf ball cleaner when he or she needs it.

Therefore, the art has included several proposals for golf ball cleaners that can be carried by the golfer. However, many of these devices are complicated. This makes these known devices difficult to operate and clean. Still further the complexity of such known devices often makes it difficult to add cleaner fluid to the device and difficult to service the device when necessary. Service is often required to clean the device so a golf ball will be properly and efficiently cleaned when desired.

Due to the intended use of such devices, dirt or other such materials often becomes lodged in various parts of the device. If such material is not removed, the efficiency of the device is vitiated. If the material is not removed, the device will eventually become useless.

Therefore, there is a need for a portable golf ball cleaner that is simple and easy to use, repair and clean.

Still further, insertion and removal of golf balls into and from many of the known devices are difficult and onerous tasks. This makes a golfer reluctant to use the golf ball cleaner as often as it could be used.

Therefore, there is a need for a portable golf ball cleaner that accommodates golf balls in an easy and efficient manner.

Still further, many devices presently available cannot be readily adjusted to accommodate the cleaning operation. That is, many presently available devices operate in the same manner whether a golf ball is very soiled or nearly clean. This may be inefficient if the golf ball is very soiled or wasteful of cleaner liquid if the golf ball is nearly clean.

Therefore, there is a need for a portable golf ball cleaner which can be adjusted according to the desired use of the device.

PRINCIPAL OBJECTS OF THE INVENTION

It is a main object of the present invention to provide a portable golf ball cleaner.

It is another object of the present invention to provide a portable golf ball cleaner that is simple and easy to use, repair and clean.

It is another object of the present invention to provide a portable golf ball cleaner that accommodates golf balls in an easy and efficient manner.

It is another object of the present invention to provide a portable golf ball cleaner which can be adjusted according to the desired use of the device.

SUMMARY OF THE INVENTION

These, and other, objects are achieved by a golf ball cleaner comprising a housing having a rear wall with an inner surface, a first side wall, a second side wall, a width dimension extending between the first side wall and the second side wall, a first end, a second end, and a longitudinal dimension extending between the first end and the second end; a cleaner liquid-containing compartment on the first side wall of the housing and including a planar inner wall spaced from the first side wall of the housing and extending from the inner surface of the rear wall of the housing in the direction of the longitudinal axis of the housing from the first end of the housing to the second end of the housing, and bristles on the inner wall of the cleaner liquid-containing compartment; a scrubbing element on the second side wall of the housing and including a planar inner wall spaced from the second side wall of the housing and extending from the inner surface of the rear wall of the housing in the direction of the longitudinal axis of the housing from the first end of the housing to the second end of the housing, and bristles on the inner wall of the scrubbing element; the bristles on the inner wall of the cleaner liquid-containing compartment being spaced apart from the bristles on the inner wall of the scrubbing element along the direction of the width dimension of the housing; a golf ball-accommodating channel defined between the bristles on the inner wall of the cleaner liquid-containing compartment and the bristles on the inner wall of the scrubbing element; a golf ball-moving element movably mounted on the inner surface of the rear wall of the housing and including a body having a proximal end and a distal end, a handle on the proximal end of the body of the golf ball-moving element, a golf ball-supporting platform on the distal end of the body of the golf ball-moving element and movable between a first location adjacent to the first end of the housing and a second location adjacent to the second end of the housing; a clip unit on the rear wall of the housing; a filling port defined into said cleaner liquid-containing compartment; and a multiplicity of openings defined through the inner wall on the cleaner liquid-containing compartment. The first side wall of the housing is flexible so it can be flexed toward the second side wall of the housing to force golf ball cleaning liquid through the openings in the inner wall of the cleaner liquid-containing compartment when the housing is squeezed. The openings are sized to keep golf ball cleaning liquid in the cleaner liquid-containing compartment unless that liquid is forced through the openings by squeezing the housing. Since most such liquid is viscous, such opening sizes are easy achieved and the device will not leak when not in use but will readily flow as much fluid to the golf ball as desired according to the amount of squeezing pressure applied to the housing.

The channel is open so it is easy to insert and remove a golf ball into a cleaning position and it is also easy to reach the bristles of the golf ball cleaner and the openings in the inner wall of the cleaner liquid-containing compartment. Thus, it is easy to clean a golf ball and also easy to service the golf ball cleaner when necessary. Thus, the golf ball cleaner embodying the present invention is easy to use as well as easy to maintain. The clip unit can be attached to a golf bag, golf cart, or to a golfer's belt as desired whereby it is easily accessible when desired.

DETAILED DESCRIPTION OF THE INVENTION other objects, features and advantages of the invention will become apparent from a consideration of the following detailed description and the accompanying drawings.

The golf ball cleaner of the present invention has an open channel into which a golf ball is placed for cleaning and which provides easy access to the golf ball as well as to the cleaning elements of the device whereby the device is easy to use as well as easy and convenient to maintain. Furthermore, the amount of cleaning fluid used in any cleaning operation is easily controlled using the golf ball cleaner of the present invention.

Figure 1:
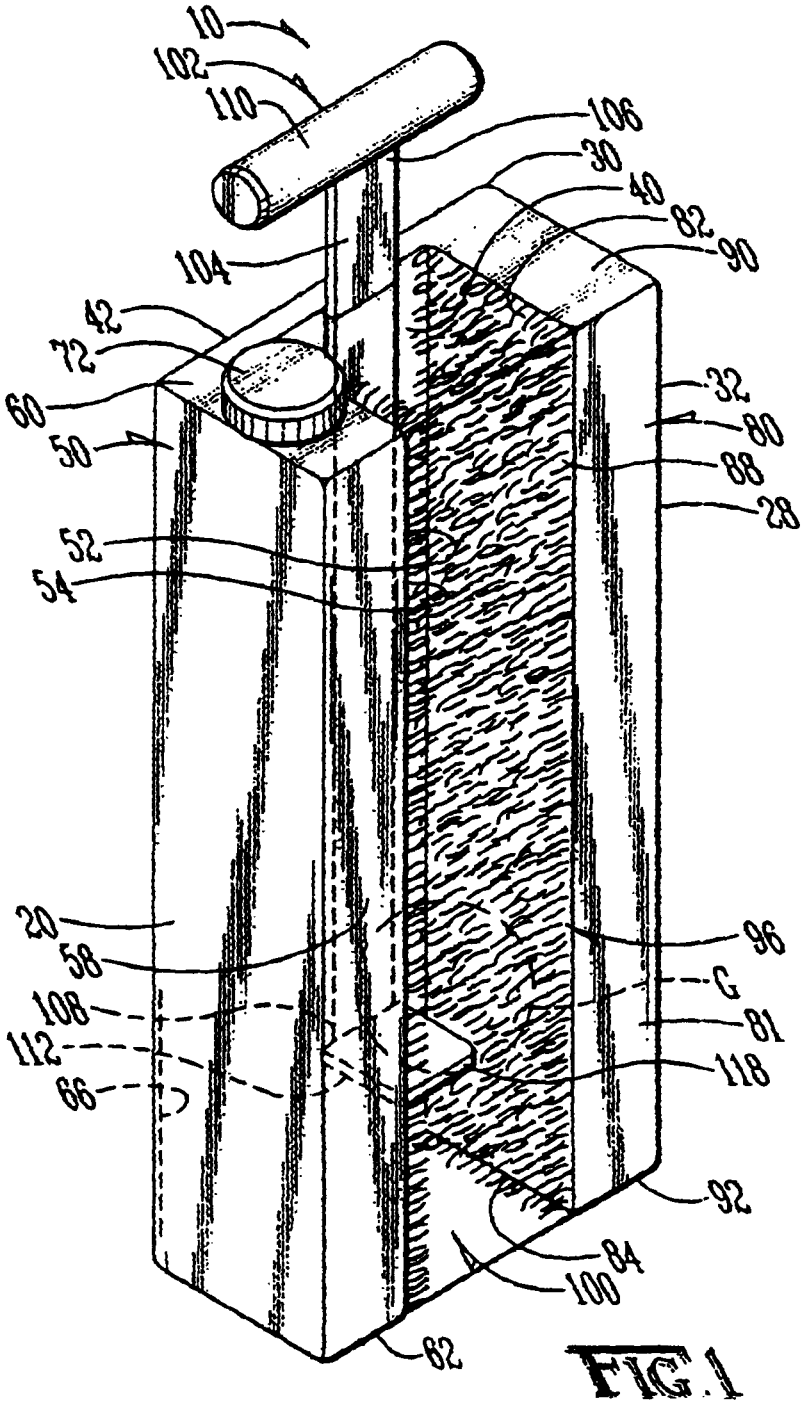
FIG. 1 is a front perspective view of a golf ball to cleaner embodying the teaching of the present invention.
Figure 2:
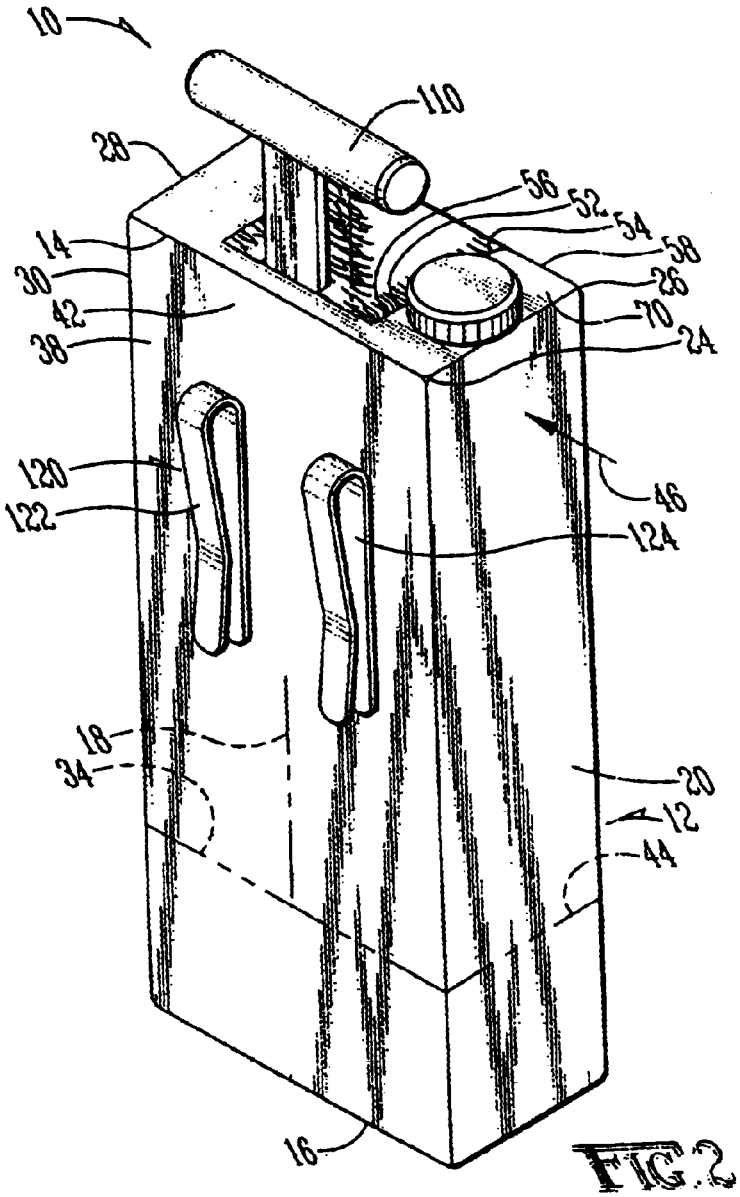
FIG. 2 is a rear perspective view of the golf ball cleaner of the present invention.

Referring to FIGS. 1 and 2, it can be seen that the present invention is embodied in a golf ball cleaner 10 which comprises a housing 12 having a first end wall 14, a second end wall 16, and a longitudinal axis 18 extending between first end wall 14 and second end wall 16. Housing 12 further includes a first side wall 20 having a rear end 24 and a front end 26 and a second side wall 28 having a rear end 30 and a front end 32. The rear ends 24, 30 of the first and second side walls 20, 28 of housing 12 are co-planar with each other and the front ends 26, 32 of the first and second side walls 20, 28 of the housing 12 are also co-planar with each other.

Housing 12 further includes a width axis 34 extending between first side wall 20 and second side wall 28, a rear wall 38 having an inner surface 40 and an outer surface 42 and extends between rear end 24 of first side wall 20 of housing 12 and rear end 30 of second side wall 28 of housing 12. A thickness axis 44 extends between the rear ends 24, 30 of the first and second side walls 20, 28 and the front ends 26, 32 of the first and second side walls 20, 28. First side wall 20 is formed of flexible material, such as rubber or the like, to be flexible to move toward second side wall 28 when force is applied to first side wall 20 in the direction of width axis 34 as indicated in FIG. 2 by arrow 46. The flexible material will tend to resume its unflexed position after the flexing force is removed.

Golf ball cleaner 10 further includes a hollow cleaner liquid-containing compartment 50 located adjacent to first side wall 20 of housing 12 and has a planar inner wall 52 spaced from first side wall 20 of housing 12 along width axis 34 of housing 12. Planar inner wall 52 is located near longitudinal axis 18 of housing 12, is located between first end wall 14 of housing 12 and second end wall 16 of housing 12, extends from inner surface 40 of rear wall 38 of housing 12 in the direction of thickness axis 44 of housing 12, has a front end 54 located to be co-planar with co-planar front ends 26 and 32 of the first and second side walls 20, 28 of housing 12, and has an outside surface 56. Compartment 50 further includes a front wall 58 that is located to be co-planar with co-planar front ends 26 and 32 of the first side wall 20 and the second side wall 28 respectively of housing 12 and front end 54 of inner wall 52 of cleaner liquid-containing compartment 50 and extends from first side wall 20 of housing 12 toward second side wall 28 of housing 12 in the direction of width axis 34 of housing 12. Compartment 50 further includes a first end wall 60 that is located to be co-planar with first end wall 14 of housing 12 and extends from first side wall 20 of housing 12 toward second side wall 28 of housing 12 in the direction of width axis 34 of housing 12. Compartment 50 further includes a second end wall 62 that is spaced from first end wall 60 of cleaner liquid-containing compartment 50 in the direction of longitudinal axis 18 of housing 12 and which is co-planar with second end wall 16 of housing 12 and extends from first side wall 20 of housing 12 toward second side wall 28 of housing 12 in the direction of width axis 34 of housing 12.

A chamber 66 defined between the first and second end walls 60 and 62 of cleaner liquid-containing compartment 50 and between first side wall 20 of housing 12 and inner wall 52 of cleaner liquid-containing compartment 50 and between inner surface 40 of rear wall 38 of housing 12 and front wall 58 of cleaner liquid-containing compartment 50. A port 70 is defined through first end wall 60 of cleaner liquid-containing compartment 50 and a closure cap 72 covers port 70 of cleaner liquid-containing compartment 50 when cleaner liquid containing compartment 50 is closed.

Figure 3:
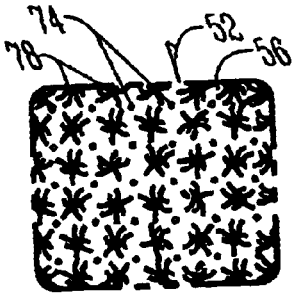
FIG. 3 is a view of a portion of an inner wall of a cleaner liquid-containing compartment showing bristles on that inner wall and openings through that inner wall through which golf ball cleaning fluid passes.

As best shown in FIG. 3, a multiplicity of openings, such as opening 74, are defined through inner wall 52 of cleaner liquid-containing compartment 50 and a multiplicity of bristles, such as bristle 78, are located on outside surface 56 of inner wall 52 of cleaner liquid-containing compartment 50. Openings 74 are sized to permit soap or other such cleaner liquid that is stored in compartment 50 to be forced through the openings when first side wall 20 is forced in direction 46, but to retain the liquid inside compartment 50 at all other times. The exact size of the openings will not be discussed as those skilled in the pertinent art will be able to size the openings based on the teaching of the present disclosure and the exact size of the openings is not considered inventive.

Golf ball cleaner 10 further includes a scrubbing element 80 on second side wall 28 of housing 12 and includes a front wall 81 on front end 32 of second side wall 28 of housing 12. Front wall 82 is co-planar with front wall 58 of cleaner liquid-containing compartment 50 and extends toward first side wall 20 of housing 12 along width axis 34 of housing 12. Scrubbing element 80 further includes a planar inner wall 82 spaced from second side wall 28 of housing 12 along width axis 34 of housing 12. Planar inner wall 82 of scrubbing element 80 is located near longitudinal axis 18 of housing 12, is located between first end wall 14 of housing 12 and second end wall 16 of housing 12, extends from inner surface 40 of rear wall 38 of housing 12 in the direction of thickness axis 44 of housing 12, has a front end 84 located to be co-planar with the co-planar front ends 26 and 32 of first and second side walls 20 and 28 of housing 12, and has an outside surface 88.

Scrubbing element 80 further includes a first end wall 90 on first end 14 of housing 12 and extends co-planar with first end wall 60 of cleaner liquid-containing compartment 50 toward first side wall 20 of housing 12 in the direction of width axis 34 of housing 12 and extends toward front wall 81 of scrubbing element 80 in the direction of thickness direction 44 of housing 12 and a second end wall 92 on second end 16 of housing 12 which extends co-planar with second end wall 62 of cleaner liquid-containing compartment 50 toward first side wall 20 of housing 12 in the direction of width axis 34 of housing 12 and which extends toward front wall 82 of scrubbing element 80 in the direction of thickness direction 44 of housing 12.

A multiplicity of bristles 96 are located on outside surface 88 of inner wall 82 of scrubbing element 80. Bristles 78 on inner wall 52 of cleaner liquid-containing compartment 50 are spaced apart from bristles 96 on inner wall 82 of scrubbing element 80. An open channel 100 is defined between bristles 78 on inner wall 52 of cleaner liquid-containing compartment 50 and bristles 86 on inner wall 82 of scrubbing element 80 and inner surface 40 of rear wall 38 of housing 12. Open channel 100 is open between front wall 58 of cleaner liquid-containing compartment 50 and front wall 81 of scrubbing element 80.

Golf ball cleaner 10 further includes a golf ball-moving element 102 movably mounted on inner surface 40 of rear wall 38 of housing 12. Golf ball-moving element 102 is located in open channel 100 between bristles 78 on inner wall 52 of cleaner liquid-containing compartment 50 and bristles 96 on inner wall 82 of scrubbing element 80, and includes a body 104 slidably mounted on inner surface 40 of rear wall 38 of housing 12 and has a proximal end 106 and a distal end 108. Distal end 108 is located in open channel 100. A handle 110 is on proximal end 106 of body 104 of golf ball-moving element 102 and extends in width direction 34 of housing 12. A golf ball-supporting platform 112 is on distal end 108 of body 104 of golf ball-moving element 102. Golf ball-supporting platform 112 has a rear end 114 located near inner surface 40 of rear wall 40 of housing 12 and a front end 118 spaced from rear end 114 of golf ball-supporting platform 112 in the thickness direction of housing 12. Golf ball-supporting platform 112 extends from inner surface 38 of rear wall 40 of housing 12 in thickness direction 44 of housing 12 and extends between bristles 78 on inner wall 52 of cleaner liquid-containing compartment 50 and bristles 96 on inner wall 82 of scrubbing element 80 in width direction 34 of housing 12.

Golf ball-supporting platform 112 of golf ball-moving element 102 moves between a first location adjacent to first end 14 of housing 12 and a second location adjacent to second end 16 of housing 12 in the direction of longitudinal axis 18 of housing 12.

Golf ball cleaner 10 further includes a clip unit 120 on outer surface 42 of rear wall 38 of housing 12 and includes two clip elements 122 and 124 mounted on outer surface 42 of rear wall 38 to be spaced apart from each other in the direction of width axis 34 of housing 12. Clip elements 122 and 124 releasably attach to a golf bag, a golf club holder, or a user's belt to support golf club cleaner 10 when it is not in use.

In use, a golf ball, such as golf ball G, is inserted into open channel 100 and is supported on golf ball-supporting platform 112. Handle 110 is manipulated to move the golf ball-supporting platform 112 between the first and second positions thereof and to move the golf ball against the bristles 78 and 96. First side wall 20 is squeezed in direction 46 to trap the golf ball against supporting platform 112 as that platform moves in both directions and to force cleaner liquid out of compartment 50 through openings 74 and onto the golf ball. Once the cleaning is completed, the golf ball is simply grasped and removed from open channel 100. As can be understood from the foregoing, the golf ball will remain in place on the supporting platform 112 due to the inward pressure applied to first wall 20 even as that supporting platform moves away from first end 14 toward second end 16. To this end, the walls of compartment 50 are slightly flexible to permit inner wall 52 to flex inwardly toward inner wall 82 when pressure is applied to wall 20 in direction 46. If necessary, a user can insert his or her finger into open channel 100 to hold the golf ball on the supporting platform 112 during movement of that supporting platform from first end 14 toward second end 16, if necessary. Certainly, friction between the bristles and the golf ball will keep the golf ball in place on the supporting platform 112 as that supporting platform moves away from second end 16 toward first end 14. Bristles 78 and 96 are formed of nylon type material and will remove dirt from a golf ball as that golf ball moves past the bristles.

Cleaning of golf ball cleaner 10 is easy since channel 100 is open and water or other cleaning fluid is easily applied to those bristles through channel 100. Additional cleaner is easily added to compartment 50 via port 70 after cap 72 has been removed.

It is understood that while certain forms of the present invention have been illustrated and described herein, it is not to be limited to the specific forms or arrangements of parts described and shown.

We claim:

1. A golf ball cleaner comprising:

a) a housing having
  (1) a first end wall,
  (2) a second end wall,
  (3) a longitudinal axis extending between the first end wall and the second end wall,
  (4) a first side wall having a rear end and a front end,
  (5) a second side wall having a rear end and a front end,
  (6) the rear ends of the first and second side walls of said housing being co-planar with each other,
  (7) the front ends of the first and second side walls of said housing being co-planar with each other,
  (8) a width axis extending between the first side wall and the second side wall,
  (9) a rear wall having an inner surface and an outer surface and extending between the rear end of the first side wall of said housing and the rear end of the second side wall of said housing,
  (10) a thickness axis extending between the rear ends of the first and second side walls and the front ends of the first and second side walls, and
  (11) the first side wall being flexible to move toward the second side wall when force is applied to the first side wall in the direction of the width axis;

b) a hollow cleaner liquid-containing compartment located adjacent to the first side wall of said housing and having
  (1) a planar inner wall spaced from the first side wall of said housing along the width axis of said housing, the planar inner wall
    (A) being located near the longitudinal axis of said housing,
    (B) being located between the first end wall of said housing and the second end-wall of said housing,
    (C) extending from the inner surface of the rear wall of said housing in the direction of the thickness axis of said housing,
    (D) having a front end located to be co-planar with the co-planar front ends of the first and second side walls of said housing, and
    (E) having an outside surface,
  (2) a front wall that is located to be co-planar with the co-planar front ends of the first side wall and the second side wall of said housing and the front end of the inner wall of said cleaner liquid-containing compartment and extends from the first side wall of said housing toward the second side wall of said housing in the direction of the width axis of said housing,
  (3) a first end wall that is located to be co-planar with the first end wall of said housing and which extends from the first side wall of said housing toward the second side wall of said housing in the direction of the width axis of said housing, (4) a second end wall that is spaced from the first end wall of said cleaner liquid-containing compartment in the direction of the longitudinal axis of said housing and which is co-planar with the second end wall of said housing and which extends from the first side wall of said housing toward the second side wall of said housing in the direction of the width axis of said housing, (5) a chamber defined between the first and second end walls of said cleaner liquid-containing compartment and between the first side wall of said housing and the inner wall of said cleaner liquid-containing compartment and between the inner surface of the rear wall of said housing and the front wall of said cleaner liquid-containing compartment, (6) a port defined through the first end wall of said cleaner liquid-containing compartment, (7) a closure cap covering the port of said cleaner liquid-containing compartment when said cleaner liquid-containing compartment is closed, (8) a multiplicity of openings defined through the inner wall of said cleaner liquid-containing compartment, and (9) a multiplicity of bristles on the outside surface of the inner wall of said cleaner liquid-containing compartment;

c) a scrubbing element on the second side wall of said housing and including (1) a front wall on the front end of the second side wall of said housing and which is co-planar with the front wall of said cleaner liquid-containing compartment and which extends toward the first side wall of said housing along the width axis of said housing, (2) a planar inner wall spaced from the second side wall of said housing along the width axis of said housing, the planar inner wall of said scrubbing element (A) being located near the longitudinal axis of said housing, (B) being located between the first end wall of said housing and the second end wall of said housing, (C) extending from the inner surface of the rear wall of said housing in the direction of the thickness axis of said housing, (D) having a front end located to be co-planar with the co-planar front ends of the first and second side walls of said housing, and (E) having an outside surface, (3) a first end wall on the first end of said housing and extending co-planar with the first end wall of said cleaner liquid-containing compartment toward the first side wall of said housing in the direction of the width axis of said housing and extending toward the front wall of said scrubbing element in the direction of the thickness direction of said housing, (4) a second end wall on the second end of said housing and extending co-planar with the second end wall of said cleaner liquid-containing compartment toward the first side wall of said housing in the direction of the width axis of said housing and extending toward the front wall of said scrubbing element in the direction of the thickness direction of said housing, and (5) a multiplicity of bristles on the outside surface of the inner wall of said scrubbing element;

d) the bristles on the inner wall of said cleaner liquid-containing compartment being spaced apart from the bristles on the inner wall of said scrubbing element;

c) an open channel defined between the bristles on the inner wall of said cleaner liquid-containing compartment and the bristles on the inner wall of said scrubbing element and the inner surface of the rear wall of said housing, said open channel being open between the front wall of said cleaner liquid-containing compartment and the front wall of said scrubbing element;

f) a golf ball-moving element movably mounted on the inner surface of the rear wall of said housing, the golf ball-moving element (1) being located in said open channel between the bristles on the inner wall of said cleaner. liquid-containing compartment and the bristles on the inner wall of said scrubbing element, (2) including a body slidably mounted on the inner surface of the rear wall of said housing and having a proximal end and a distal end, with the distal end being located in said open channel, (3) a handle on the proximal end of the body of said golf ball-moving element and which extends in the width direction of said housing, (4) a golf ball-supporting platform on the distal end of the body of said golf ball-moving element, the golf ball-supporting platform (A) having a rear end located near the inner surface of the rear wall of said housing, (B) having a front end spaced from the rear end of the golf ball-supporting platform in the thickness direction of said housing, (C) extending from the inner surface of the rear wall of said housing in the thickness direction of said housing, (D) extending between the bristles on the inner wall of said cleaner liquid-containing compartment and the bristles on the inner wall of said scrubbing element in the width direction of said housing, and (E) the golf ball-supporting platform of said golf ball-moving element moving between a first location adjacent to the first end of said housing and a second location adjacent to the second end of said housing in the direction of the longitudinal axis of said housing; and g) a clip unit on the outer surface of the rear wall of said housing and including two clip elements which are spaced apart from each other in the direction of the width axis of said housing.

2. The golf ball cleaner as described in claim 1 further including golf ball cleaner liquid contained in the golf ball cleaner liquid-containing compartment.

3. A golf ball cleaner comprising:

a) a housing having (1) a rear wall having an inner surface, (2) a first side wall, (3) a second side wall, (4) a width dimension extending between the first side wall and the second side wall, (5) a first end, (6) a second end, and (7) a longitudinal dimension extending between the first end and the second end;

b) a cleaner liquid-containing compartment on the first side wall of said housing and including (1) a planar inner wall spaced from the first side wall of said housing and extending from the inner surface of the rear wall of said housing and extending in the direction of the longitudinal axis of said housing from the first end of said housing to the second end of said housing, and (2) bristles on the inner wall of said cleaner liquid-containing compartment;

c) a scrubbing element on the second side wall of said housing and including (1) a planar inner wall spaced from the second side wall of said housing and extending from the inner surface of the rear wall of said housing and extending in the direction of the longitudinal axis of said housing from the first end of said housing to the second end of said housing, and (2) bristles on the inner wall of said scrubbing element;

d) the bristles on the inner wall of said cleaner liquid-containing compartment being spaced apart from the bristles on the inner wall of said scrubbing element along the direction of the width dimension of said housing;

e) a golf ball-accommodating channel defined between the bristles on the inner wall of said cleaner liquid-containing compartment and the bristles on the inner wall of said scrubbing element;

f) a golf ball moving element movably mounted on the inner surface of the rear wall of said housing and including (1) a body having a proximal end and a distal end, (2) a handle on the proximal end of the body of said golf ball-moving element, (3) a golf ball-supporting platform on the distal end of the body of said golf ball-moving element and movable between a first location adjacent to the first end of said housing and a second location adjacent to the second end of said housing;

g) a clip unit on the rear wall of said housing;

h) a filling port defined into said cleaner liquid-containing compartment; and i) a multiplicity of openings defined through the inner wall on said cleaner liquid-containing compartment.

4. The golf ball cleaner defined in claim 3 wherein the first side wall of said housing is flexible.

* * * * *